US005291619A

United States Patent [19]

Adorjan

[11] Patent Number: 5,291,619

[45] Date of Patent: Mar. 8, 1994

[54] WATER CLOSET SEALING ADAPTER

[76] Inventor: Charles R. Adorjan, 9423 Lippincott, Davison, Mich. 48423

[21] Appl. No.: 862,037

[22] Filed: Apr. 2, 1992

[51] Int. Cl.[5] ..... E03D 11/17

[52] U.S. Cl. ..... 4/252.6; 4/252.1

[58] Field of Search ..... 4/252.1, 252.4, 252.5, 4/252.6, 252.2, 252.3; 285/56, 57, 58, 59, 60, 177

[56] References Cited

U.S. PATENT DOCUMENTS

| | | | |
|---|---|---|---|
| 2,152,719 | 4/1939 | Williams | 4/252.6 |
| 2,479,837 | 8/1949 | Hollaender | 285/60 |
| 3,238,538 | 3/1966 | Turner | 4/252.6 |
| 4,722,556 | 2/1988 | Todd | 285/177 X |

FOREIGN PATENT DOCUMENTS

| | | | |
|---|---|---|---|
| 0665797 | 6/1963 | Canada | 4/252.5 |

*Primary Examiner*—William A. Cuchlinski, Jr.
*Assistant Examiner*—Willie Morris Worth
*Attorney, Agent, or Firm*—Donald C. Bolger

[57] ABSTRACT

A water closet sealing adapter for sealing a water closet to a drainage pipe which prevents leakage of gas or liquids. A gasket having a hole in the center is attached to the top of the adapter. The adapter has grooves near the bottom and in conjunction with a lip seal provides a sealing adjustment feature. The lip seal is installed in the appropriate groove and then installed into the drainage pipe. The outlet to the water closet is inserted through the inside of the gasket. The water closet is then lowered and seated in place and secured. The adapter prevents leakage of gas or liquid from the joint between the water closet and drainage pipe and allows for some movement of the joint.

1 Claim, 2 Drawing Sheets

WATER CLOSET SEALING ADAPTER

BACKGROUND OF THE INVENTION

The field of the invention is generally that of plumbing fixtures for water closet installations, and more specifically, to an improved water closet sealing adapter.

Water closets are traditionally connected to either 3 inch or 4 inch drainage piping--cast iron, in any one of these weights or grades, service weight, no-hub or extra heavy, plastic pipe--PVC or ABS. PVC is available in two grades (schedules) that are accepted for drainage use within a building. Schedule 40 commonly known as DWV, and another weight that is officially termed 3.25 O.D. PVC and is commonly referred to as schedule 30 or thin wall pipe. The schedule 30 pipe is available in the 3 inch size only. Copper and galvanized steel pipe are also used in drainage systems. There are different dimension tolerances for each of the three grades of cast iron and for the plastic pipes that affect the inside diameter of the pipes.

Floor outlet water closets are traditionally mounted or connected in the following manner. A "closet flange" is attached to the drainage piping. Cast iron closet flanges are used with cast iron and galvanized steel drainage pipe and are attached by packing with oakum and poring hot lead in the annular space. Where the lead is cooled, it is caulked (expanded) using caulking irons and a hammer. There are also closet flanges that attach by mechanical means.

Plastic closet flanges are attached with solvent cements to the plastic pipe. Copper closet flanges are soft soldered to the copper drainage pipe. Once the closet flange is set, the joint between the outlet horn of the water closet and the closet flange is made with either a wax ring or plumbers putty. Very little putty is used for this purpose today but, prior to the introduction of the preformed wax ring it was used exclusively.

The discharge horn outlet of the water closet varies in outside dimensions from one manufacturer to another. The only dimension requirement for ASME standard A112.19.2U is that the outside diameter of the outlet cannot exceed 3.75 inches.

Another dimensional factor stipulated in ASME A112.19.2U is the depth of the recess measured from the part of the fixture that contacts the floor and the underside surface of the water closet. This recess is required to be not less than 0.5 inches and no more than 0.75 inches.

This combination of varying pipe sizes, various inside diameter and outside diameter dimensions of the pipe in a given size, the various outside dimensions of the water closet discharge horn outlet, and the varying depth of the water closet recess does create a difficult connection problem that up to now has been addressed only by the use of putty or wax rings to effect a seal between the water closet and drainage pipe.

Code authorities and the plumbing trade acknowledge the weakness of this connection and recognize it as the weakest connection in the plumbing system. Leakage from this joint can come in two forms. First, the leaking joint will allow sewer gas to enter the building and can lead to illness and the spread of disease. Second, if a stoppage occurs in the drainage system, the joint can leak that not only allows sewage into the building but because it is hidden in the water closet recess, it can breed germs and rot the floor under the water closet.

The purpose of this invention is to provide a method of joining between the water closet and the drainage pipe that meets or exceeds the pressure test requirements of the entire plumbing drainage system within a building.

There are approximately 11 million water closets produced in the United States every year. In addition there are at least 11 million more water closets that are removed and reset in alteration and repairs. In all there are approximately 20 to 25 million water closets now being installed every year with a potential of leaking sewer gas or sewage into the living spaces of a building.

SUMMARY OF THE INVENTION

Generally speaking, the present invention comprises a novel sealing adapter for water closet installations.

It is an object of the present invention to provide a novel adapter that prevents leakage of sewer gas from the water closet to drainage pipe connection.

It is a further object of the invention to provide a novel adapter that prevents leakage of liquid from the water closet to drainage pipe connection.

It is another object of the invention to provide a novel adapter that is flexible and not allow leakage of gas or liquid from a water closet to drainage pipe connection.

It is a further object of the invention to provide a novel adapter that is flexible and will prevent dampness in floor areas around water closet when buildings or floors settle.

It is another object of the invention to provide a low cost adapter that is simple to install.

It is another object of this invention to provide a novel adaptor that will accommodate the varying dimensions of the pipe and the water closet discharge outlet.

It is a further object of the invention to provide a novel adaptor that will allow connection to a drainage pipe that is somewhat out of vertical.

It is another object of the invention to allow some movement between the water closet and drainage pipe without sacrificing the integrity of the water and gas tight seal.

It is a further object of the invention to provide a novel adaptor that will extend the long trap leg of a water closet and improve the flushing capability of a low consumption water closet.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figures of the accompanying drawings and is described in detail hereinafter. It is to be taken as representative of the multiple embodiments of the invention which lie within the scope of the invention.

DESCRIPTION OF THE PREFERRED EMBODIMENTS

Figure 1:
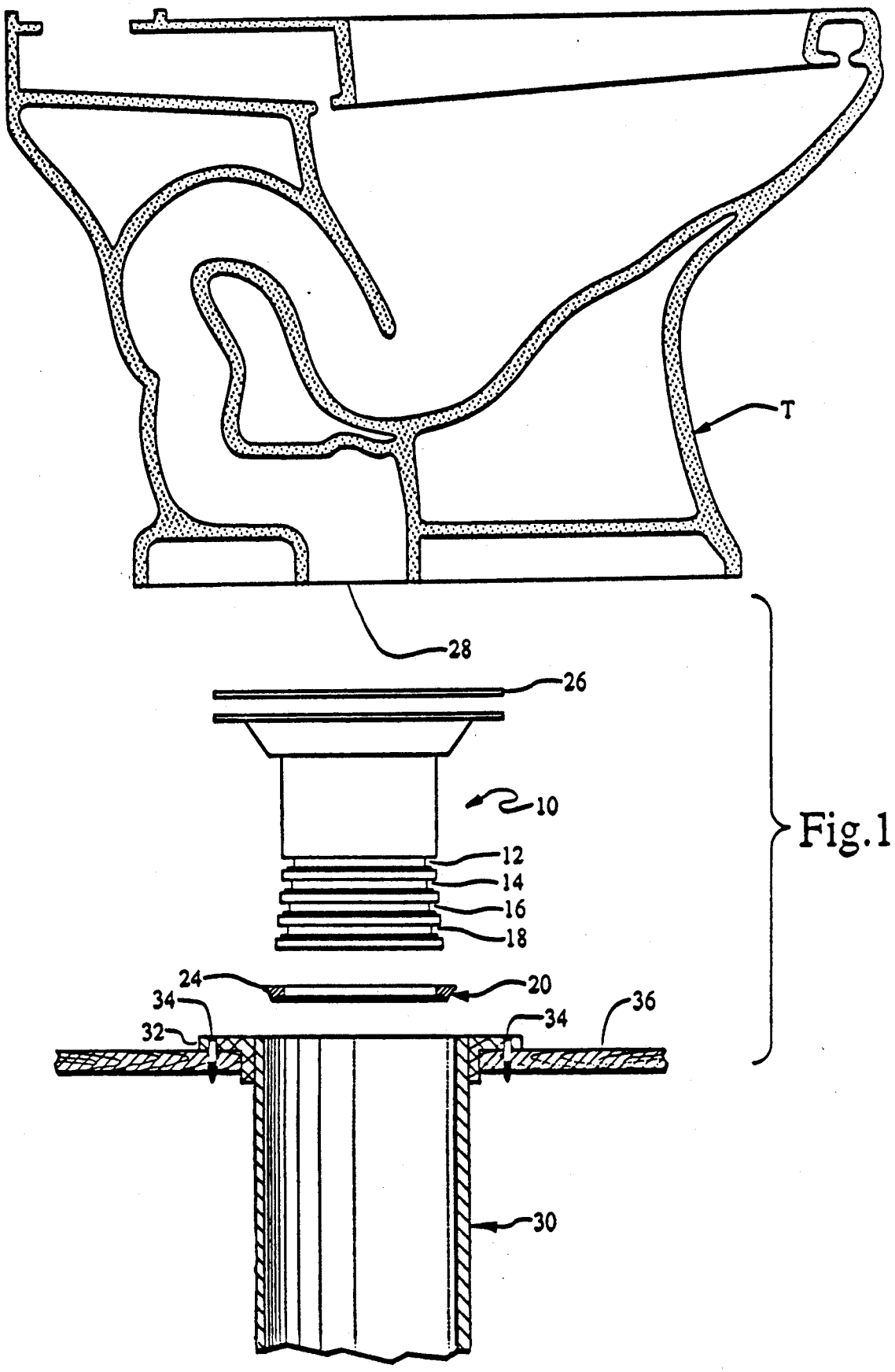
FIG. 1 is a elevation view showing one exemplary embodiment of one representative form of the invention connecting a water closet to a drainage pipe.

Referring to FIG. 1, water closet T has outlet 28 that varies in dimension by various manufacturers. Gasket 26 is a flat circular gasket that has an opening in center to fit tightly over the smallest dimension of outlet 28 and will also stretch over the largest dimension of outlet 28.

Adapter 10 is a circular pipe with cone shaped upper end that is bonded or mechanically attached to gasket 26. Adapter 10 has groove 12, groove 14, groove 16, and groove 18 on the lower portion of the adapter. The diameter of groove 12 is less than the diameter of groove 14. The diameter of groove 14 is less than the diameter of groove 16. The diameter of groove 16 is less than the diameter of groove 18. By having the different sizes of grooves an adjustment is provided for lip seal 20. Lip seal 20 is stretched over adapter 10 and then lip seal 20 is seated in either groove 12, or groove 14, or groove 16, or groove 18.

Drainage pipe 30 with flange 32 is secured to floor 36 by screws 34. Lip seal 20 has a sealing bead 24 which seals along the inside of drainage pipe 30.

Figure 2:
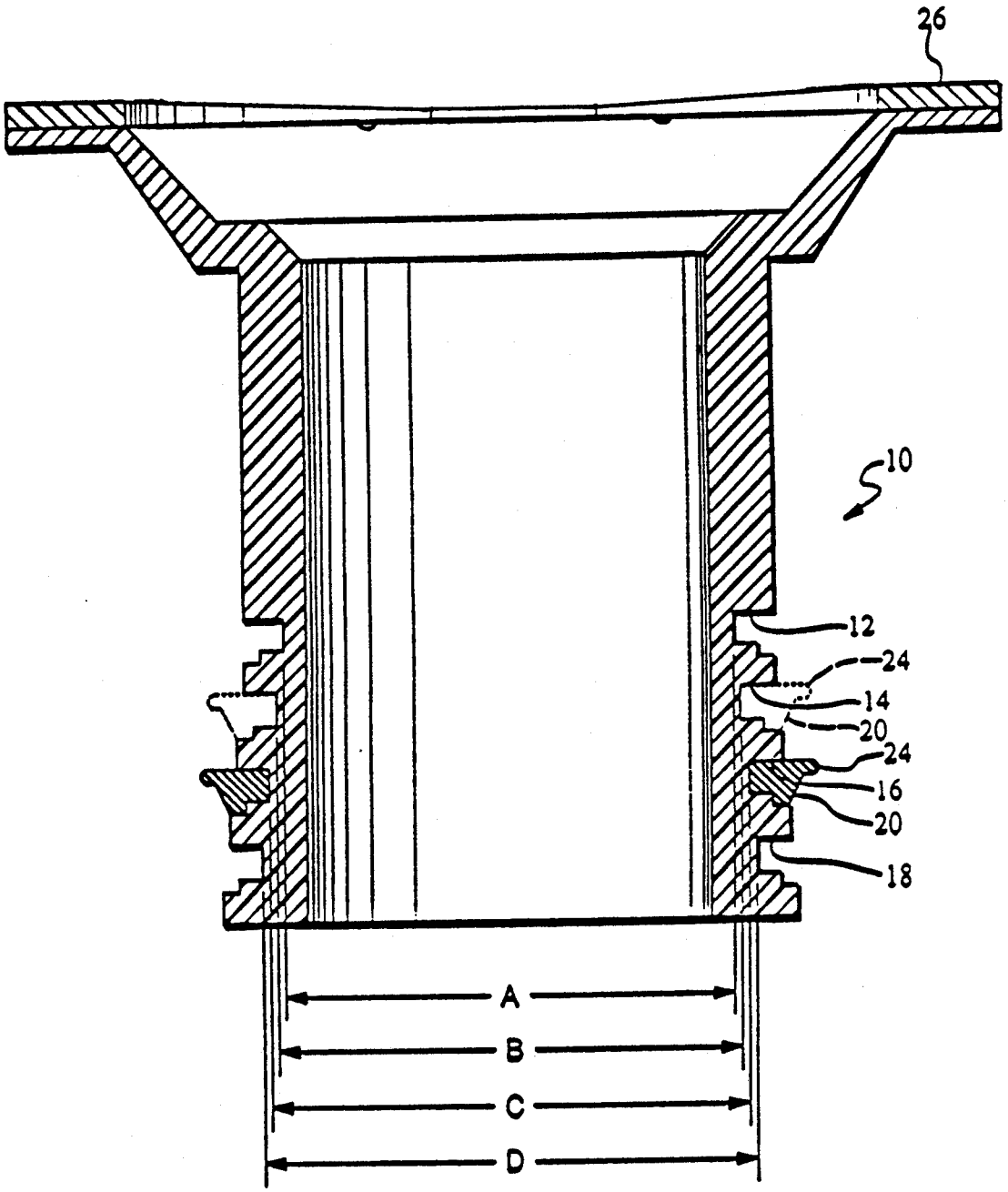
FIG. 2 is a cross sectional view showing one exemplary embodiment of one representative form of the circular adapter.

Referring to FIG. 2, the cross section of circular adapter 10 is shown with gasket 26 bonded or mechanically attached to adapter 10. Groove 12 has a diameter A. Groove 14 has a diameter B. Groove 16 has a diameter C. Groove 18 has a diameter D. Diameter A is less than diameter B. Diameter B is less than diameter C. Diameter C is less than diameter D. Diameters A, B, C, and D provide an adjustment feature for lip seal 20 and the varying inside diameter or the drainage pipe.

To adjust for the smallest size drainage pipe 30, lip seal 20 is placed in groove 12. With lip seal 20 in groove 12, the outside diameter of lip seal 20 protrudes beyond the lower outer circular section of adapter 10. To adjust to larger sizes of drainage pipe 30, lip seal 20 is moved progressively lower to groove 14, then to lower groove 16, and then to lower groove 18, until an interference fit is obtained.

Figure 3:
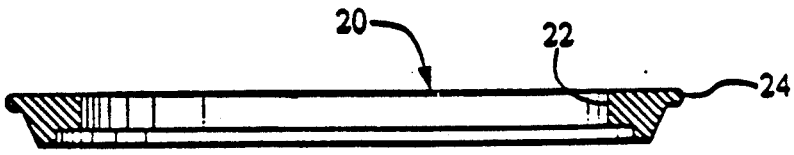
FIG. 3 is a cross sectional view showing one exemplary embodiment of one representative form of the circular lip seal.

Referring to FIG. 3, lip seal 20 has seated portion 22 which seals on base of groove 12, or groove 14, or groove 16, or groove 18. Sealing bead 24 seals against the inside diameter of drainage pipe 30.

To install adapter 10, a measurement is taken of the inside diameter of drainage pipe 30. Then a groove is chosen which will produce an interference fit. Lip seal 20 is stretch over the appropriate groove. Adapter 10 with lip seal 20 in place is then inserted into drainage pipe 30. Next, water closet T is placed on top of gasket 26 until outlet 28 is seated in the opening in gasket 26. Then, water closet T is lower to the floor surface and secured in place by water closet T retaining system.

What is claimed is:

1. A water closet sealing device comprising:

an elastic gasket having a cylindrical cross section and having an inside diameter less than an outside diameter of a water closet discharge horn outlet, wherein an inner surface of said gasket seals against an outer surface of said water closet discharge horn outlet by an interference fit when said water closet outlet is seated therethrough;

an adapter having an upper portion and a lower portion with at least one recessed groove in the lower portion;

means for securing said gasket to said adapter upper portion;

means received within said at least one recessed groove for providing a seal between said lower portion and an inside surface of a drainage pipe.

* * * * *